US008141733B2

(12) United States Patent
Matsuoka

(10) Patent No.: US 8,141,733 B2
(45) Date of Patent: Mar. 27, 2012

(54) BEVERAGE CONTAINER HAVING CIRCULAR ARCS

(75) Inventor: Kenshi Matsuoka, Tokyo (JP)

(73) Assignee: The Coca-Cola Company, Atlanta, GA (US)

( * ) Notice: Subject to any disclaimer, the term of this patent is extended or adjusted under 35 U.S.C. 154(b) by 324 days.

(21) Appl. No.: 11/654,563

(22) Filed: Jan. 18, 2007

(65) Prior Publication Data

US 2008/0173614 A1 Jul. 24, 2008

(51) Int. Cl.
*B65D 1/02* (2006.01)
*B65D 1/42* (2006.01)
*B65D 23/10* (2006.01)

(52) U.S. Cl. ..... 215/383; 215/384; 215/398; 220/675; 220/771

(58) Field of Classification Search ..... 215/384, 215/398, 379, 383; 220/675, 906, 771; D9/530, D9/541

See application file for complete search history.

(56) References Cited

U.S. PATENT DOCUMENTS

| | | | | | |
|---|---|---|---|---|---|
| D3,243 | S | * | 11/1868 | French | D9/541 |
| D34,783 | S | * | 7/1901 | Schies | D9/546 |
| D49,924 | S | * | 11/1916 | Graham | D9/541 |
| D174,591 | S | * | 4/1955 | Parsell | D9/541 |
| 2,892,540 | A | * | 6/1959 | Tupper | 206/427 |
| D234,742 | S | * | 4/1975 | Stut | D7/379 |
| D251,104 | S | * | 2/1979 | Sanchez et al. | D7/706 |
| 4,155,474 | A | * | 5/1979 | Bizzarri | 215/365 |
| 4,279,349 | A | * | 7/1981 | Aigner | 215/6 |
| 4,570,808 | A | * | 2/1986 | Campbell et al. | 215/11.1 |
| 4,749,092 | A | | 6/1988 | Sugiura et al. | |
| 4,993,565 | A | * | 2/1991 | Ota et al. | 215/384 |
| 5,215,203 | A | * | 6/1993 | Malcolm | 215/384 |
| 5,398,827 | A | * | 3/1995 | Armstrong et al. | 215/6 |
| 5,398,828 | A | * | 3/1995 | Valyi | 215/396 |
| 6,112,925 | A | * | 9/2000 | Nahill et al. | 215/382 |
| 6,161,713 | A | * | 12/2000 | Krich | 215/384 |
| 6,536,619 | B2 | * | 3/2003 | Gaydosh et al. | 215/375 |
| 6,981,604 | B2 | * | 1/2006 | Iizuka et al. | 215/381 |
| 7,080,747 | B2 | * | 7/2006 | Lane et al. | 215/381 |
| D567,101 | S | * | 4/2008 | Pierre | D9/561 |
| 7,416,090 | B2 | * | 8/2008 | Mooney et al. | 215/381 |
| 2005/0247739 | A1 | * | 11/2005 | Grant et al. | 222/386 |

FOREIGN PATENT DOCUMENTS

| | | | |
|---|---|---|---|
| DE | 14 82 573 | A1 | 4/1969 |
| DE | 20 62 684 | A1 | 7/1972 |
| DE | 41 30 320 | A1 | 3/1993 |
| DE | 200 18 882 | U1 | 2/2001 |
| EP | 0 225 251 | A1 | 6/1987 |
| EP | 1 350 726 | A1 | 10/2003 |
| FR | 2 576 283 | A1 | 7/1986 |
| GB | 18752 | A1 | 0/1911 |
| JP | 07-300121 | | 11/1995 |
| JP | 11-091754 | | 4/1999 |
| JP | 2005-247393 | | 9/2005 |
| JP | 2006-016076 | | 1/2006 |

* cited by examiner

OTHER PUBLICATIONS

International Search Report and Written Opinion, dated May 9, 2008, Application No. PCT/US2008/000566.

*Primary Examiner* — Sue Weaver

(74) *Attorney, Agent, or Firm* — Parks IP Law LLC; Collen A. Beard, Esq.

(57) ABSTRACT

A plastic beverage container that can withstand deformation by positive pressure and that can be stably stored lying on its side is provided. The beverage container for storing a product under positive pressure includes a body portion having an outer wall made of plastic, and the body portion has a symmetrical cross-sectional shape formed by a plurality of circular arcs.

9 Claims, 8 Drawing Sheets

BEVERAGE CONTAINER HAVING CIRCULAR ARCS

FIELD OF THE INVENTION

This invention relates to a plastic beverage container for storing a liquid, such as soft drinks or carbonated drinks. In particular, the invention is directed to a plastic beverage bottle for storing a liquid under positive pressure.

BACKGROUND OF THE INVENTION

Generally, a plastic bottle, such as a PET bottle, is widely known as a beverage container. Plastic bottles vary in their sizes. Bottles may have a small size, which is less than 500 ml, a medium size, which is around 1,000 ml, and a large size, which is about 1,500-2,000 ml.

In order to store plastic bottles of various sizes, a refrigerator typically has a bottle holder or pocket that can accommodate large bottles. A small refrigerator, however, may not be equipped with a bottle holder or pocket for large or even medium-size bottles, and those bottles can only be stored on the side on shelves. Even for a large refrigerator, if the bottle holder or pocket is occupied by other items, bottles may have to be stored on the shelves.

Recently, a bottle having a distinctive cross-sectional shape has been desired to attract many consumers at shops. For example, bottles having a circular, rectangular, or heart-shaped cross-section or bottles having a flat cross-sectional shape, as a whole, have been developed. (See Japanese Laid-Open Patents H11-91754, H7-300121, 2006-16076, and 2005-247393).

A cross-sectional shape of a bottle is designed in consideration for pressure in the bottle after it is filled with a liquid. In general, many bottles for soft drinks, such as juice or tea, have a rectangular cross-section. In addition, these bottles are often provided with ribs or grooves to prevent deformation of the bottles due to pressure decrease after they are filled with a liquid and a loss of commercial value. On the other hand, bottles for carbonated drinks typically have a circular cross-section. This is because the bottles need to be able to withstand positive internal pressure to which they are exposed.

Rectangular cross-sectional bottles may be stably placed and stored in a refrigerator. The rectangular cross-sectional bottles, however, have low resistance against positive internal pressure caused by carbonated drinks and are not suitable for storing carbonated drinks. On the other hand, while circular cross-sectional bottles may be able to withstand positive internal pressure, they roll easily on a refrigerator shelve. Furthermore, shortening the height of the circular cross-sectional bottles often results in an increase in diameter, and it becomes difficult to store them in a bottle holder or pocket in the refrigerator.

SUMMARY OF THE INVENTION

It is accordingly an object of the invention to provide a plastic beverage container that can withstand deformation by positive pressure and that can be stably stored on its side. In accordance with the invention, a beverage container for storing a product under positive pressure is provided with a body portion having an outer wall made of plastic, the body portion having a symmetrical cross-sectional shape formed by a plurality of circular arcs.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE EMBODIMENTS

Figure 1:
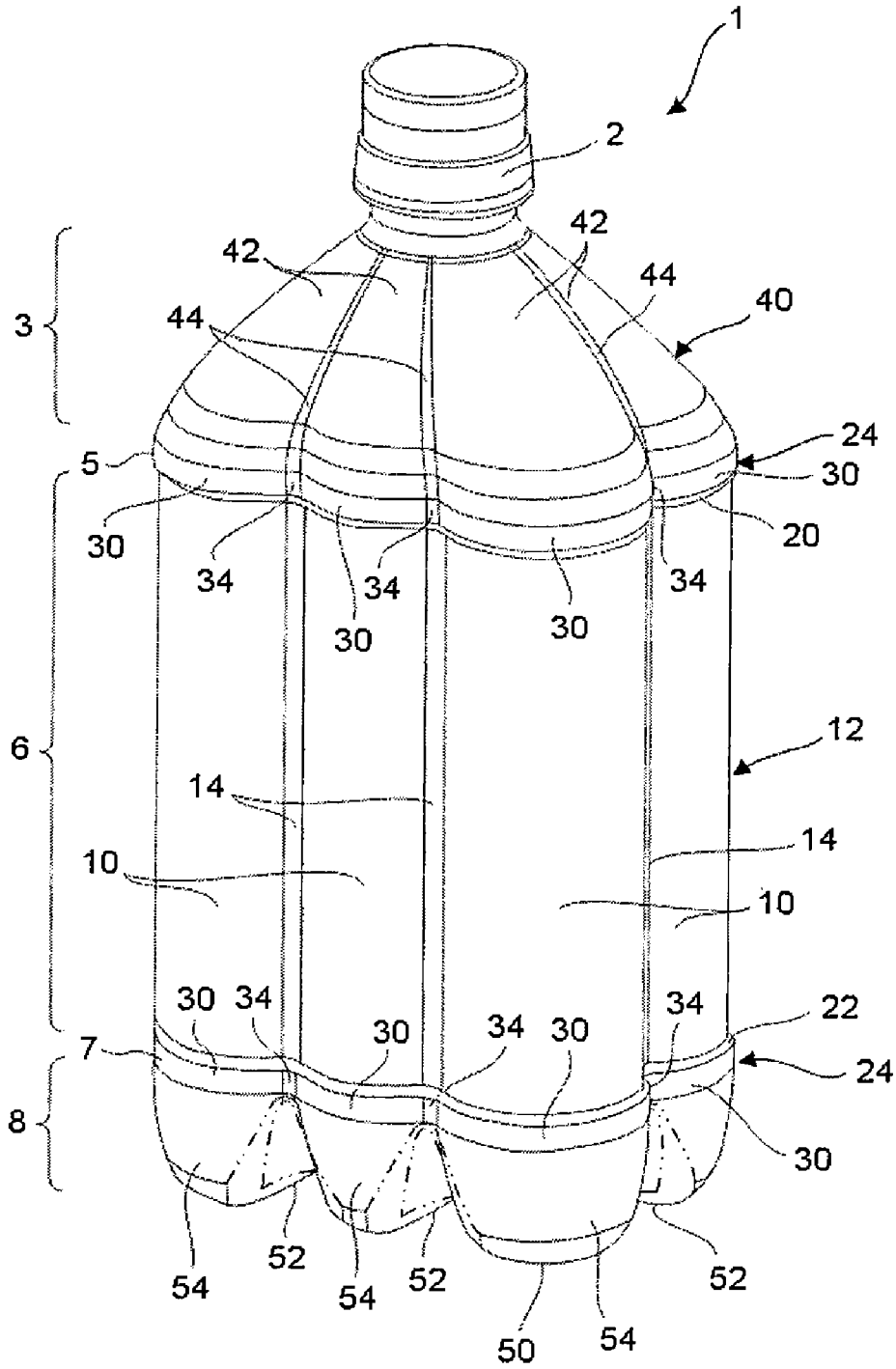
FIG. 1 is a perspective view of a plastic bottle according to one embodiment of the invention.

A beverage container or bottle for storing a product under positive pressure is provided with a body portion having an outer wall made of plastic, the body portion having a symmetrical cross-sectional shape formed by a plurality of circular arcs.

Because of the cross-sectional shape, positive pressure is more evenly distributed compared to a rectangular cross-sectional shape. As a result, the body portion has an improved resistance against positive pressure, and deformation of the body portion can be avoided. Additionally, if pressure in the body portion is positive, the body portion can be strengthened. Also, compared with a bottle having a circular cross-section, the bottle of this embodiment does not roll so easily and can be stably stored on its side.

The body portion is recessed from other parts of the bottle, and it may not contact the surface on which the bottle is placed on its side. However, if the body portion expands due to positive pressure and contacts the surface, the bottle can still be stably stored on its side.

According to one exemplary embodiment, each of the plurality of circular arcs may have the same radius of curvature. By such a configuration, the internal positive pressure in the body portion can be evenly distributed, and it helps preventing deformation of the body portion.

Preferably, the center of curvature of the circular arc is located inwardly with respect to the bottle, and the center of curvature of arcs where the circular arcs intersect is located outwardly with respect to the bottle. Also, in one embodiment, the length of each of the circular arcs may be the same or substantially the same.

In one exemplary embodiment, the bottle may have two, three, four, five, or six circular arcs. Depressed portions may be formed between the circular arcs, and the depressed portions may be configured and sized to be held by fingers. When the cross-section of the bottle is viewed, the depressed portions may be configured such that one, two, or three of the circular arcs may fit between the fingers holding the depressed portions.

Based on this configuration, the body portion of the bottle can be easily held, reducing an effort needed from a person for holding the bottle. For example, when the bottle has two circular arcs, a person can hold the bottle by placing or hooking his or her fingers on the two depressed portions and placing the palm over one circular arc. Also, when the bottle has three or four circular arcs, a person can hold the bottle by placing or hooking a finger on at least one depressed portion and placing the palm over one or two circular arcs. Moreover, when the bottle has five or six circular arcs, a person can hold the bottle by placing or hooking a finger on at least one depressed portion and placing the palm over one or preferably two or three circular arcs.

According to one embodiment, the entire body portion or a part of the body portion may have the same cross-sectional shape. Also, the bottle may have its maximum circumferential portions located above and below the body portion.

Because the cross-sectional shape is provided entirely or partially in the body portion, the strength of the bottle is increased. Also, because the maximum circumferential portions are located above and below the body portion, the bottle can be stably placed on its side, conveyed in manufacturing lines, and sold by a vending machine. Moreover, even if the body portion expands due to positive internal pressure, the commercial value of the bottle may be maintained even though the body portion protrudes. In one preferred embodiment, the maximum circumferential portions may have a circumference that longitudinally extends in parallel.

According to one embodiment, the maximum circumferential portions may have the same cross-sectional shape as the body portion. Such a configuration makes the bottle difficult to roll when placed on its side, and therefore, the bottle can be stably stored on the side.

Also, the bottle may have a shoulder portion adjacent to the maximum circumferential portion located above the body portion and a bottom portion adjacent to the maximum circumferential portion located below the body portion. At least a part of the shoulder portion and the bottom portion, for example, a part closer to the body portion, may have the same cross-sectional shape as the body portion.

In this configuration, the internal positive pressure in the bottle can be evenly distributed, and deformation due to the pressure can be prevented. Also, when the plastic bottle is formed by injection blow molding, the body portion, the shoulder portion, and the bottom portion may be easily formed. Furthermore, the bottom portion may be shaped as a combination of tubular cylinders, and a number of the tubular cylinders may correspond to the number of the circular arcs.

According to one exemplary embodiment, the cross-section of the body portion is uniform in the longitudinal direction of the bottle. This configuration may improve load strength in the longitudinal direction of the bottle.

In one embodiment, the cross-section of the body portion may be formed basically from a polygon, and a part of the circular arc may be located on each vertex of the polygon. This configuration allows maintaining the strength and impact resistance at the locations that correspond to the vertices without increasing the wall thickness at the locations. Moreover, the bottle may have an outlet for the liquid contained in the bottle. In one exemplary embodiment, the bottle may have a capacity of containing 800 ml to 1,200 ml of a liquid.

As explained above, the plastic bottle may be able to prevent deformation due to positive internal pressure and can be stably placed on its side.

Reference will now be made in detail to the present embodiments of the invention, examples of which are illustrated in the accompanying drawings.

Figure 2:
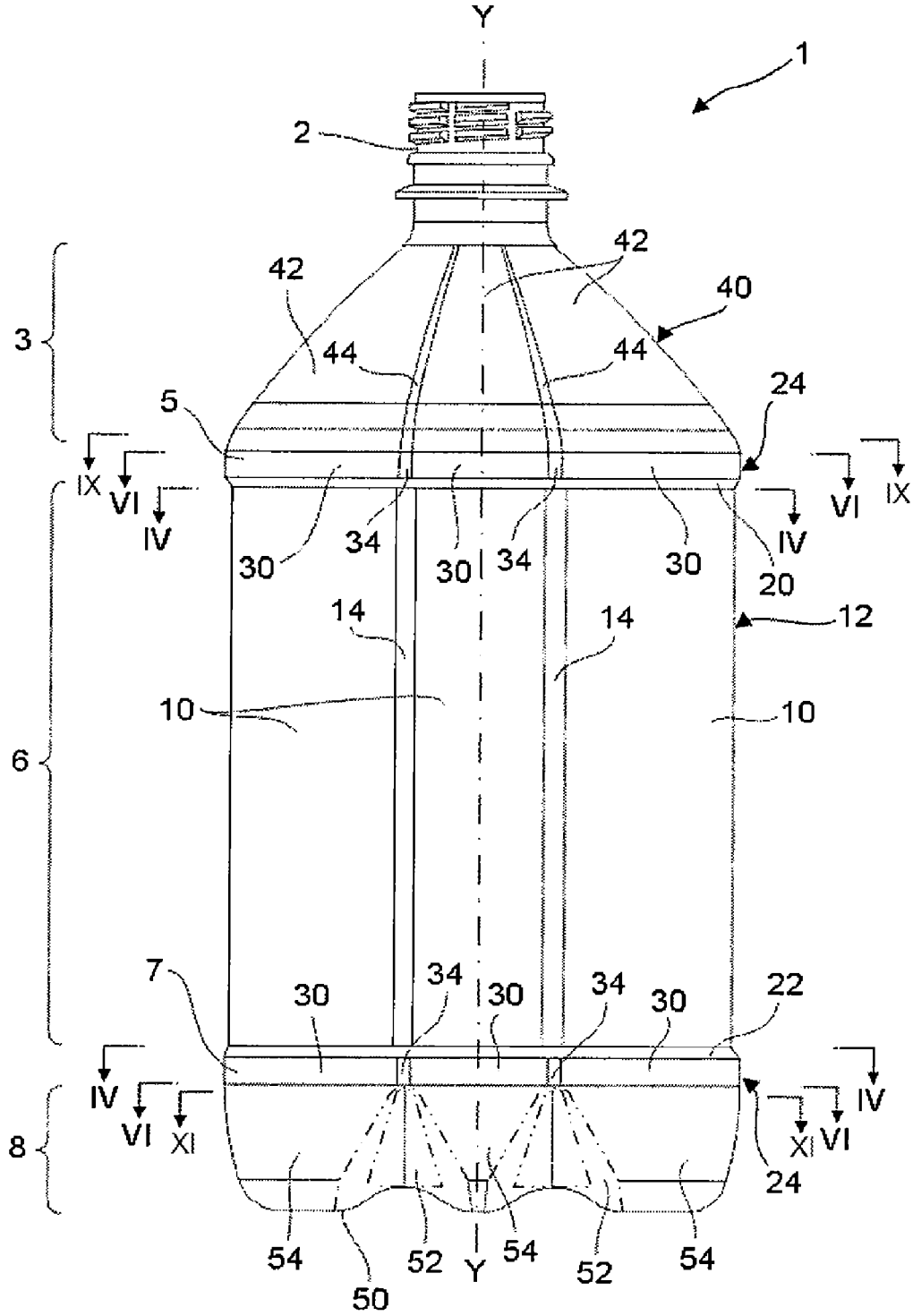
FIG. 2 is a front view of the plastic bottle shown in FIG. 1.
Figure 3:
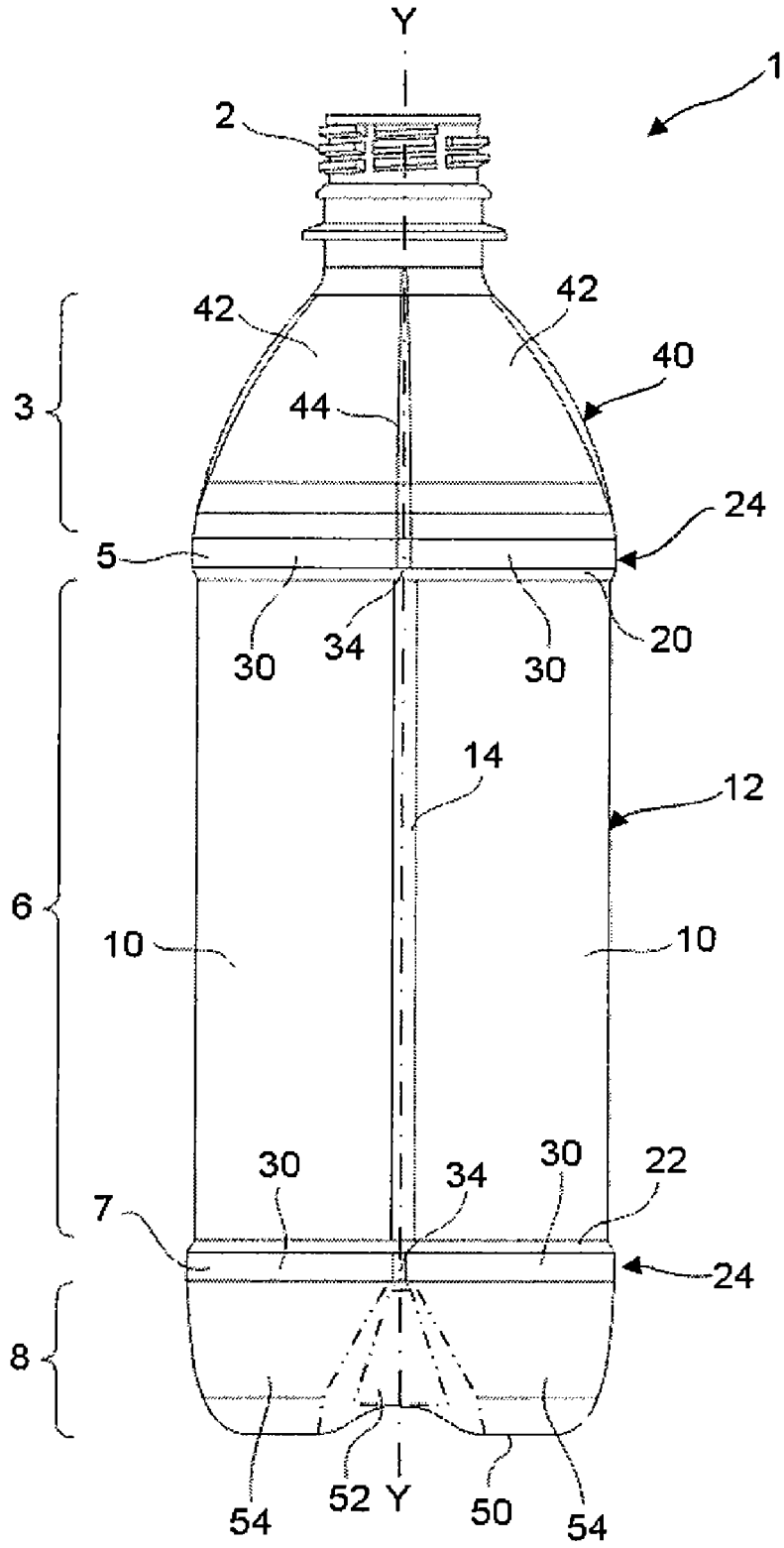
FIG. 3 is a side view of the plastic bottle shown in FIG. 1.

FIGS. 1-3 are perspective, front, and side views of the plastic bottle according to one embodiment. A plastic bottle 1 may be made primarily from a thermoplastic resin, such as polyethylene, polypropylene, polyethylene terephthalate, and may be formed by various molding methods, such as blow molding, injection blow molding, and two-axis stretch blow molding. Preferably, bottle 1 may be formed by an injection blow molding using the Cold Parison method.

After the formation, bottle 1 may be washed and sterilized, for example, by a heated water sterilization or a chlorine sterilizer. Then bottle 1 may be filled with a liquid, and an outlet 2 of bottle 1 is sealed by a cap, providing a bottle in a sealed state.

Bottle 1 is suitable for use as a pressure resistant bottle and formed by the process described below. In other words, bottle 1 is suitable for use under positive internal pressure in the sealed state. Thus, bottle 1 may be suitable to be filled with a carbonated drink and an effervescent drink. In addition, for non-carbonated drinks, such as green tea, oolong tea, tea, coffee, and fruit juice, adding liquid nitrogen in bottle 1 before filling the non-carbonated drink provides positive internal pressure in bottle 1. Therefore, bottle 1 may be suitable for storing non-carbonated drinks under positive internal pressure. In short, bottle 1 can store both carbonated drinks and non-carbonated drinks under the internal pressure of 0 to 0.8 MPa. Under this internal pressure, bottle 1 can resist deformation. Bottle 1 is also suitable for storing drinks not under positive pressure.

Terms used in the specification are defined as follows:

Positive internal pressure means pressure inside of the bottle being higher than the outside pressure (atmospheric pressure). Width, depth, and height of bottle 1 mean lengths of bottle 1 in the left-right direction, the front-back direction, the top-bottom direction of the central axis Y-Y, respectively, in FIG. 2. Cross-sectional shape means a shape of a cross-section of bottle 1 at a plane (a cross-section) perpendicular to the central axis Y-Y. Inwardly with respect to the bottle means a direction closer to the central axis Y-Y from a bottle wall, and outwardly with respect to the bottle means a direction farther away from the center axis Y-Y from the bottle wall. Radial direction means a radial direction of a circle where the center of the circle is located along the center axis Y-Y, and circumferential direction means a direction along a perimeter of a cross-section.

The size of bottle 1 may be determined in consideration for a size of a sales floor or a refrigerator of a consumer. Usually shelves for bottles at a supermarket or a convenience store are designed to display and accommodate large bottles with the height of 310 mm and small bottles with the height of 230 mm. Also, a home-use refrigerator is often equipped with a holder or pocket having 71.0 mm depth to store a 1-liter milk carton (with a square cross-section having a 70.5 mm side.)

Considering these designs, the height of bottle 1 may preferably be 230 mm or less, and its depth may preferably be 71.0 mm or less. In the embodiment described herein, bottle 1 has about 98 mm width, about 70 mm depth, and about 220 mm height. Also, the capacity of bottle 1 is designed to be about 1,000 ml. However, the capacity of bottle 1 is not limited to a particular number. For convenience, ease of carrying around and pouring the liquid stored inside, and use in household, the capacity of bottle 1 may preferably be more than 800 ml and less than 1,200 ml.

Each part of bottle 1 is described as follows. Bottle 1 has, from the top in the direction of the central axis Y-Y (a perpendicular axis), an outlet or mouth 2, a shoulder portion 3, a maximum circumferential portion 5, a body portion 6, a maximum circumferential portion 7, and a bottom 8 as one body. These parts (2, 3, 5, 6, 7, and 8) form a bottle wall that can store a liquid inside.

Bottle 1 on its upper part has one outlet 2, which is the minimum circumferential portion of the bottle. Outlet 2 can be opened or closed by a cap (not shown in the figure) that is screwed onto the outlet.

Figure 4:
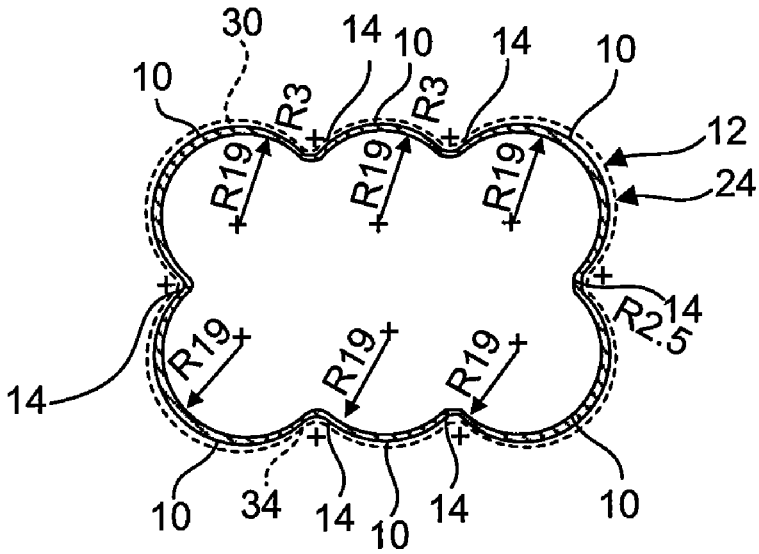
FIG. 4 is a cross-sectional view at line IV-IV in FIG. 2.

As illustrated in FIG. 4, body portion 6 has a symmetrical cross-sectional shape 12 which is formed by a combination of six circular arcs 10. Cross-sectional shape 12 may be symmetrical with respect to the line that extends across the central axis Y-Y and in the width direction and may also be symmetrical with respect to the line that extends across the central axis Y-Y and in the depth direction. Cross-sectional shape 12 may be formed basically from a rectangle having a longer side in the width direction, and the vertices of the basic rectangle are located in intermediate parts of the circular arcs 10. As such, the strength and impact resistance can be maintained at the locations that correspond to the vertices without increasing the wall thickness at the locations.

The centers of curvature for six circular arcs 10 are located inwardly with respect to the bottle, and each of circular arcs has the same radius of curvature. Preferably, the radius of curvature is about 15 to 25 mm, and in the embodiment shown in FIG. 4, it is 19 mm. Among six arcs 10, four of the arcs located at four corners of cross-sectional shape 12 have the same length. The two remaining arcs have the same length, but their length is preferably about ¼ to about ⅔ of the length of the arcs located at the four corners.

Because a part made up of one arc 10 is formed as it is expanded outwardly with respect to the bottle, the part can be called as an expanded portion of body portion 6. On the other hand, a part between two adjacent arcs 10 is formed as it is depressed inwardly with respect to the bottle, the part can be called as a depressed portion 14 of body portion 6. In other words, body portion 6 has six expanded portions and six depressed portions 14 alternatively.

Depressed portions 14 are configured to be held or hooked by fingers when bottle 1 is held by hand. Depressed portion 14 is formed by an arc having its radius of curvature outwardly with respect to the bottle, and the radius of curvature is preferably about 1-25 mm. In the embodiment described, the radius of curvature of four depressed portions 14 formed on the front and back sides of bottle 1 is 3 mm, and the radius of curvature of two depressed portions 14 formed on the left and right sides of bottle 1 is 2.5 mm.

Figure 5:
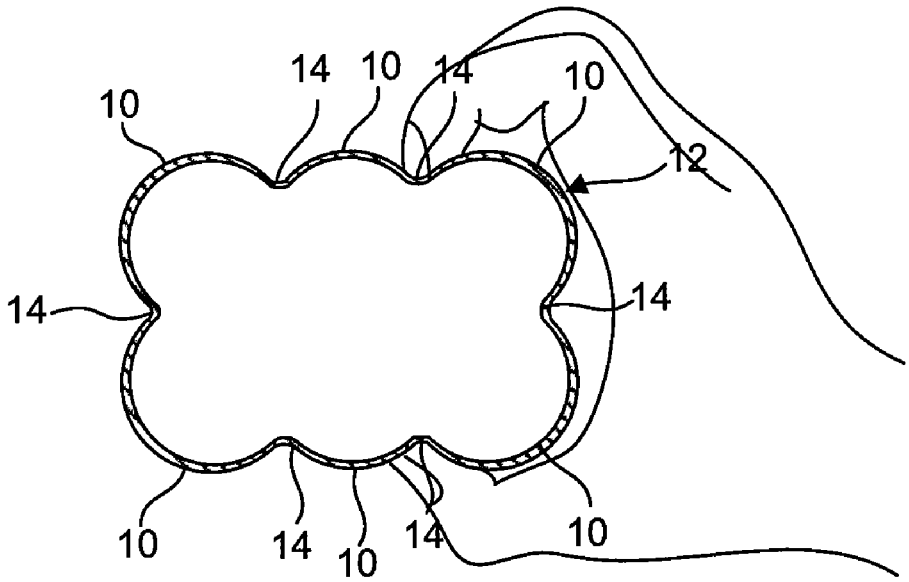
FIG. 5 is a cross-sectional shape of a body portion and a human hand holding the body portion.

FIG. 5 illustrates a relationship between a human hand and cross-sectional shape 12. The human hand shown in the figure has a typical size for an adult. As shown in FIG. 5, body portion 6 can be held by placing fingers on two depressed portions 14 located on the front and back sides. For cross-sectional shape 12 in this embodiment, a child having a small hand can place fingers such that two circular arcs 10 fit between the fingers, and an adult having a large hand can place fingers such that three or four circular arcs 10 fit between the fingers. Because body portion 6 can be held at depressed portions 14, it can be easily held by hand. Also, a palm fits over arc 10 when body portion 6 is held, it can provide better fitting.

As illustrated in FIGS. 1-3, cross-sectional shape 12 is provided along the central axis Y-Y and along entire body portion 6. In this configuration, the load strength in the vertical direction can be maintained. Also, cross-sectional shape 12 does not change along the central axis Y-Y. By having the same cross-sectional shape 12 in the vertical direction, the load strength of bottle 1 in the vertical direction can be improved.

In other embodiments, body portion 6 may have a narrow portion somewhere in the vertical direction, and cross-sectional shape 12 may be changed in the vertical direction. Moreover, body portion 6 may be provided with ribs or grooves. In this configuration, cross-sectional shape 12 is partially provided in body portion 6.

Next maximum circumferential portions 5 and 7 are described. Maximum circumferential portions 5 and 7 are formed above and below body portion 6. Maximum circumferential portion 5 is provided above body portion 6 and is located adjacent to body portion 6 via a sloped surface 20, and maximum circumferential portion 7 is provided below body portion 6 and is located adjacent to body portion 6 via a sloped surface 22. Maximum circumferential portions 5 and 7 extend parallel to the central axis Y-Y for a certain length (for example 5 mm). Maximum circumferential portions 5 and 7 are formed with the same dimension and provide the maximum width and depth of bottle 1. Therefore, when bottle 1 is placed on its side on a surface, maximum circumferential portions 5 and 7 contact the surface before the other parts of the bottle.

Maximum circumferential portions 5 and 7 have the same cross-sectional shape 24. The cross-sectional shape 24 is similar or substantially similar in shape to the cross-section shape 12. In cross-sectional shape 24 and cross-sectional shape 12, the expanded and depressed portions correspond to each other in the direction of the central axis Y-Y.

Figure 6:
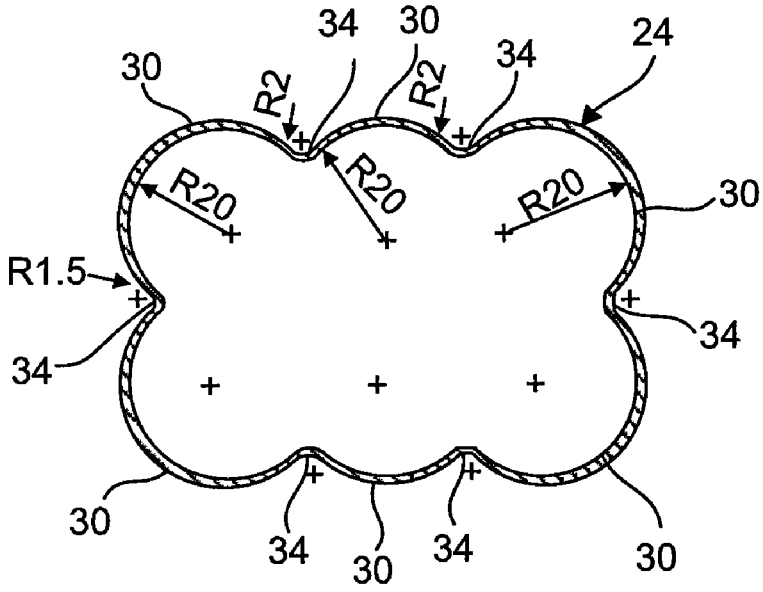
FIG. 6 is a cross-sectional view at line VI-VI in FIG. 2.

FIG. 6 shows a cross-section at line VI-VI in FIG. 2 and illustrates cross-sectional shape 24. Cross-sectional shape 24 is formed by a combination of six circular arcs 30 and has a depressed portion 34 between two arcs 30 adjacent to each other.

Arcs 30 have its center of curvature located inwardly with respect to the bottle, and each has the same radius of curvature (20 mm). This radius of curvature is preferably is the same as or substantially larger than that of arcs 10. An intermediate part of arc 30 is located in a position that corresponds to each vertex of rectangular cross-sectional shape 24.

Depressed portion 34 is formed by an arc whose center of curvature is located outwardly with respect to the bottle. The radius of curvature of depressed portion 34 may be the same or slightly smaller than that of depressed portion 14. In this embodiment, the radius of curvature of four depressed portions 34 located in the front or back side of bottle 1 is 2 mm, and the radius of curvature of two depressed portions 34 located in the left or right side of bottle 1 is 1.5 mm.

Because maximum circumferential portions 5 and 7 are located above and below body portion 6, bottle 1 does not easily roll when placed on its side and can be stably placed on its side. Additionally, it is possible to stably covey bottle 1 in a manufacturing line, and bottle 1 may be readily sold by a vending machine. Also, because body portion 6 has a recessed shape, body portion 6 does not expand greatly even when it is expanded due to positive pressure. As a result, bottle 1 may not lose its commercial value, and it becomes easier to place a label that display, for example, a product name on body portion 6.

Next, shoulder portion 3 is described in reference to FIGS. 1-3. Shoulder portion 3 is a portion below the outlet 2 and above maximum circumferential portion 5, and it has a sloping shoulder shape when viewed from the front view as shown in FIG. 2. Shoulder portion 3 in its entire portion has a cross-sectional shape 40 that may have the same or similar shape as cross-sectional shapes 12 and 24.

Figure 9:
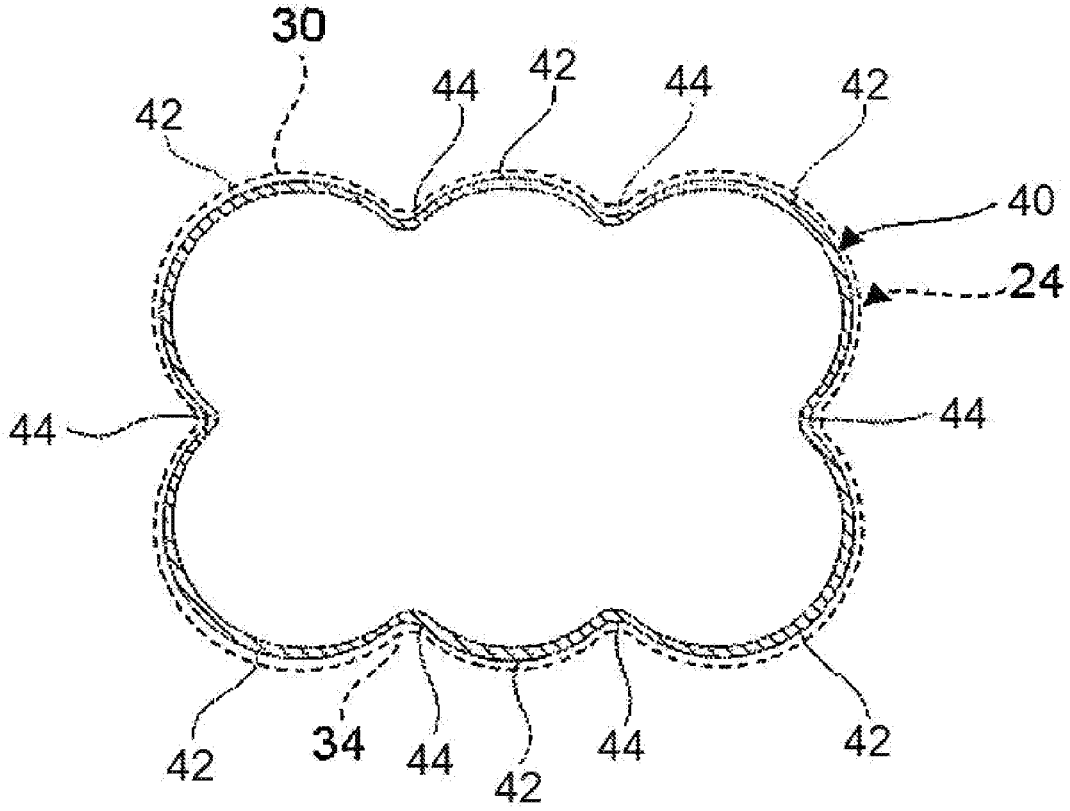
FIG. 9 is cross-sectional view at line IX-IX in FIG. 2.

As illustrated in FIG. 9, cross-sectional shape 40 may be similar or substantially similar in shape to cross-section shape 12 or 24. In other words, cross-sectional shape 40 has a symmetric shape that is formed by a combination of six arcs 42 and has a depressed portion 44 between two arcs 42 adjacent to each other. Arc 42 and depressed portion 44 are continuously formed from arc 30 and depressed portion 34 at maximum circumferential portion 5 and correspond to arc 30 and depressed portion 34. Cross-sectional shape 40 becomes smaller towards above. Cross-sectional shape 40 need not be formed in the entire portion of shoulder portion 3. However, cross-sectional shape 40 is preferably provided at a portion close to body portion 6.

Next, bottom portion 8 is described in reference to FIGS. 1-3 and 10. Bottom portion 8 is a portion below maximum circumferential portion 7 and has a bottom surface 50 that contacts the surface. Bottom portion 8 is formed such that its width and depth gradually and slightly become smaller toward the bottom.

Figure 10:
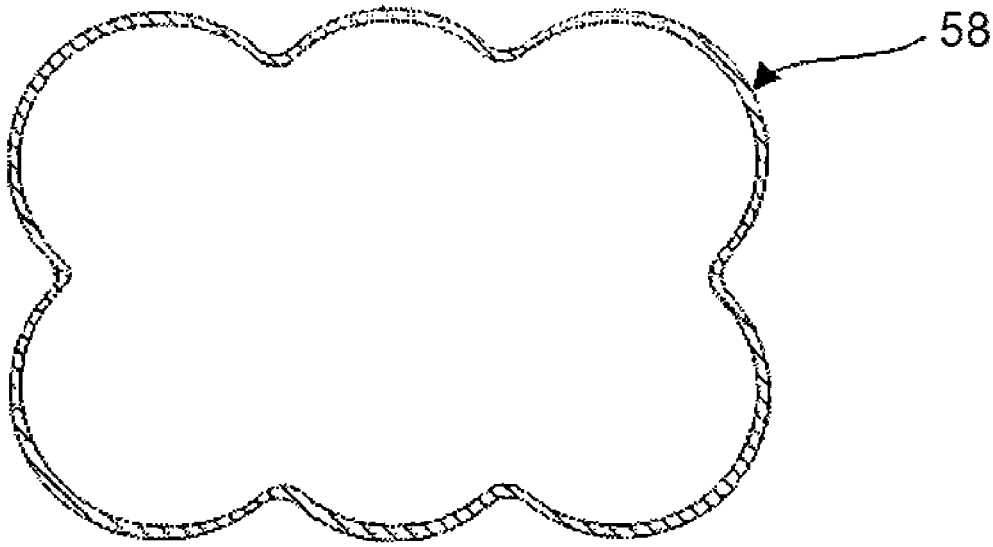
FIG. 10 is a cross-sectional view at line XI-XI in FIG. 2.

Bottom portion 8 has six trough sections 52 and six legs 54 that are separated by trough sections 52. Trough sections 52 and legs 54 are continuously formed from arc 30 and depressed portion 34 at maximum circumferential portion 7 and correspond to arc 30 and depressed portion 34. Trough section 52 is formed such that it is gradually depressed and widened toward the bottom. Leg 54 has a hollow cylinder shape, and its cross-section is formed on a circular arc. As illustrated in FIG. 10, bottom 8 is said to have a cross-sectional shape 58 that is the same as cross-sectional shapes 12 and 24 at least near body portion 6.

As described above, bottle 1 according to one exemplary embodiment has a body portion 6 with cross-sectional shape 12 described above. Therefore, compared with a bottle having a rectangular cross-section, positive pressure in the bottle is more evenly distributed. As a result, it is possible to increase pressure resistance against the internal positive pressure in body portion 6 and to prevent deformation of body portion 6. Also, because the pressure in the bottle becomes positive when the bottle is sealed, body portion 6 becomes stronger.

Furthermore, not only body portion 6 but also shoulder portion 3, maximum circumferential portions 5 and 7, and bottom portion 8 has a same or similar cross-sectional shapes 24 and 40. Thus, positive pressure in the bottle is more evenly distributed at these portions, and deformation at portions 3, 5, 7, and 8 due to positive pressure can be prevented and the portions may be strengthened.

In the embodiment described herein, a pressure resistance bottle is provided. Even when bottle 1 is placed on its side as described above, bottle 1 does not roll because the circumferential portion that contacts the surface is not circular. Thus, bottle 1 can be stably stored on its side on shelves in a refrigerator at home. Also, body portion 6 can be easily held by hand. Moreover, the height of bottle 1 can be reduced without increasing the entire diameter, and bottle 1 can be easily stored in a refrigerator.

Figure 7:
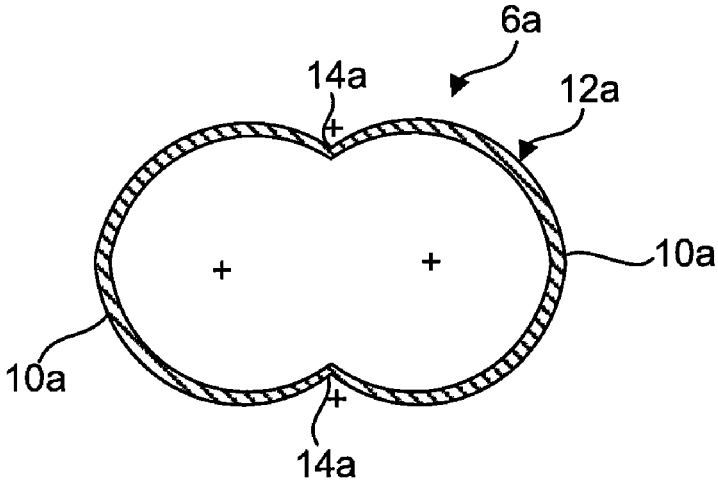
FIG. 7 is a cross-sectional view of a body portion of a plastic bottle according to another embodiment of the invention.

In another embodiment, cross-sectional shape 12 of bottle 1 may have a different number of circular arcs 10. For example, as shown in FIG. 7, a cross-sectional shape 12*a* may have a symmetrical shape formed by a combination of two circular arcs 10*a*. The radius of curvature of arc 10*a* may be, for example, 35 mm. A radius of curvature of depressed portion 14*a* between two adjacent arcs 10*a* may be, for example, 3 mm. Such a bottle may be held by one hand at body portion 6*a* by placing or hooking fingers on two depressed portions 14*a* and placing a palm over one of arcs 10*a*.

Figure 8:
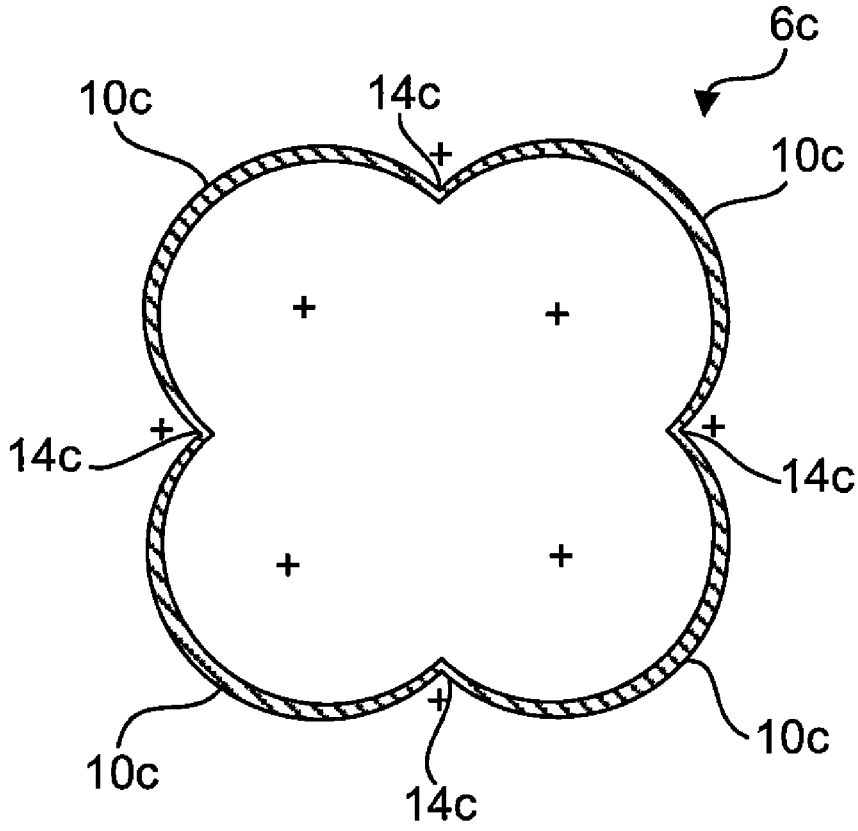
FIG. 8 is a cross-sectional view of a body portion of a plastic bottle according to another embodiment of the invention.

Furthermore, as shown in FIG. 8, cross-sectional shape 12*c* may have a symmetrical shape formed by a combination of four circular arcs 10*c*. Cross-sectional shape 12*c* is formed basically from a rectangle, and preferably an intermediate part of arc 10*c* is located at a position that corresponds to a vertex of the rectangle. The radius of curvature of arc 10*c* may be, for example, 35 mm, and a radius of curvature of depressed portion 14*c* between two adjacent arcs 10*c* may be, for example, 3 mm. Such a bottle may be held by one hand at body portion 6*c* by placing or hooking a finger or fingers on one or two depressed portions 14*c* and placing a palm over one or two arcs 10*c*.

Embodiments of body portion 6 having different numbers of circular arcs 10 were described above in reference to FIGS. 7 and 8. The cross-sectional shape at shoulder portion 3, maximum circumferential portion 5, body portion 6, maximum circumferential portion 7, or bottom portion 8 may have a different number of arcs 10 correspondingly. Preferably the cross-sectional shape is formed from two to eight arcs, and more preferably, two to six arcs.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A beverage container for storing a product under positive pressure, comprising:

a body portion having an outer wall made of plastic, the body portion having a symmetrical cross-sectional shape formed by a plurality of circular arcs, each of the plurality of circular arcs having a center of curvature located inwardly relative to the container, the centers being spaced apart from one another, the body portion being recessed from other portions of the beverage container, a maximum circumferential portion having an outer wall made of plastic, the maximum circumferential portion having a symmetrical cross-sectional shape, the maximum circumferential portion providing the maximum width and depth of the beverage container, the maximum circumferential portion including a band-shaped portion that extends parallel to a central vertical axis of the container, the maximum circumferential portion including a first maximum circumferential portion and a second maximum circumferential portion, a shoulder portion adjacent to the first maximum circumferential portion located above the body portion, and a bottom portion adjacent to the second maximum circumferential portion located below the body portion, wherein, at least part of the shoulder portion and the bottom portion has the same cross-sectional shape as the body portion.

2. The beverage container of claim 1, wherein each of the plurality of circular arcs has a same radius of curvature.

3. The beverage container of claim 2, wherein the body portion has the cross-sectional shape formed by two, three, four, five, or six circular arcs, and further comprising depressed portions between the circular arcs.

4. The beverage container of claim 3, wherein the depressed portions are configured to be held by fingers, and one, two, or three of the circular arcs are fit between the fingers holding the depressed portions.

5. The beverage container of claim 2, wherein the body portion has the cross-sectional shape entirely or partially, and the first maximum circumferential portion is located above the body portion and the second maximum circumferential portion is located below the body portion.

6. The beverage container of claim 5, wherein the first maximum circumferential portion and the second maximum circumferential portion have the same cross-sectional shape as the body portion.

7. The beverage container of claim 2, wherein the body portion has the same cross-sectional shape in a longitudinal direction of the container.

8. The beverage container of claim 2, wherein centers of the plurality of circular arcs form a polygon.

9. The beverage container of claim 2, further comprising an outlet for the product.

* * * * *